US005398773A

United States Patent [19]

Baker

[11] Patent Number: 5,398,773

[45] Date of Patent: Mar. 21, 1995

[54] FORCING TOOL FOR LOCKED DOORS, GATES AND THE LIKE

[76] Inventor: Charles W. Baker, 2814 Doidge Ave., Pinole, Calif. 94564

[21] Appl. No.: 232,818

[22] Filed: Apr. 22, 1994

[51] Int. Cl.[6] ..... B25D 1/00

[52] U.S. Cl. ..... 173/90; 173/202

[58] Field of Search ..... 173/90, 126, 121, 202, 173/203; 254/93 R

[56] References Cited

U.S. PATENT DOCUMENTS

| | | | |
|---|---|---|---|
| 3,071,994 | 1/1963 | Swenson | 173/121 |
| 3,483,727 | 12/1969 | Giannetto | 173/202 |
| 3,792,739 | 2/1974 | Deike | 173/126 |
| 4,681,171 | 7/1987 | Kee | 173/90 |
| 5,329,685 | 7/1994 | Gillespie | 173/90 |

*Primary Examiner*—Scott A. Smith
*Attorney, Agent, or Firm*—Harold D. Messner

[57] ABSTRACT

An access tool for smashing against a door knob of a door is describe and comprises a pair of telescoping cylinders. The outer guiding cylinder includes a side wall concentric of an axis of symmetry. A hoisting handle of U-shaped cross section is attached at one end of the outer cylinder (the hoisting handle including a pair of transverse legs having openings near the termini thereof) using a bolt-nut combination. The bolt includes a bolt shank extending through a pair of diametrically opposed openings in the side wall of the outer cylinder and thence through the openings in the transverse legs of the handle, whereby achieving pivotable attachment of the hoisting handle. The inner cylinder also includes a side wall that differs from that of the outer cylinder in that a stepped end wall is provided in the mid-region thereof. The stepped end wall includes a central opening for receiving an anvil bolt. A compression spring is positioned within the cylinders on a side opposite the anvil bolt in contact with the stepped end wall of the inner cylinder and the bolt shank of the hoisting handle wherein rectilinear movement of the inner cylinder in a direction toward the bolt shank, causes compression of the spring to provide a "cocked" action state for the cylinders. A unitary trigger mechanism and carrying handle is attached to the outer cylinder near a mid-region thereof for manipulation of the tool and for disconnectably connecting the outer and inner cylinders so as to provide both a locking state and to provide a release state.

23 Claims, 5 Drawing Sheets

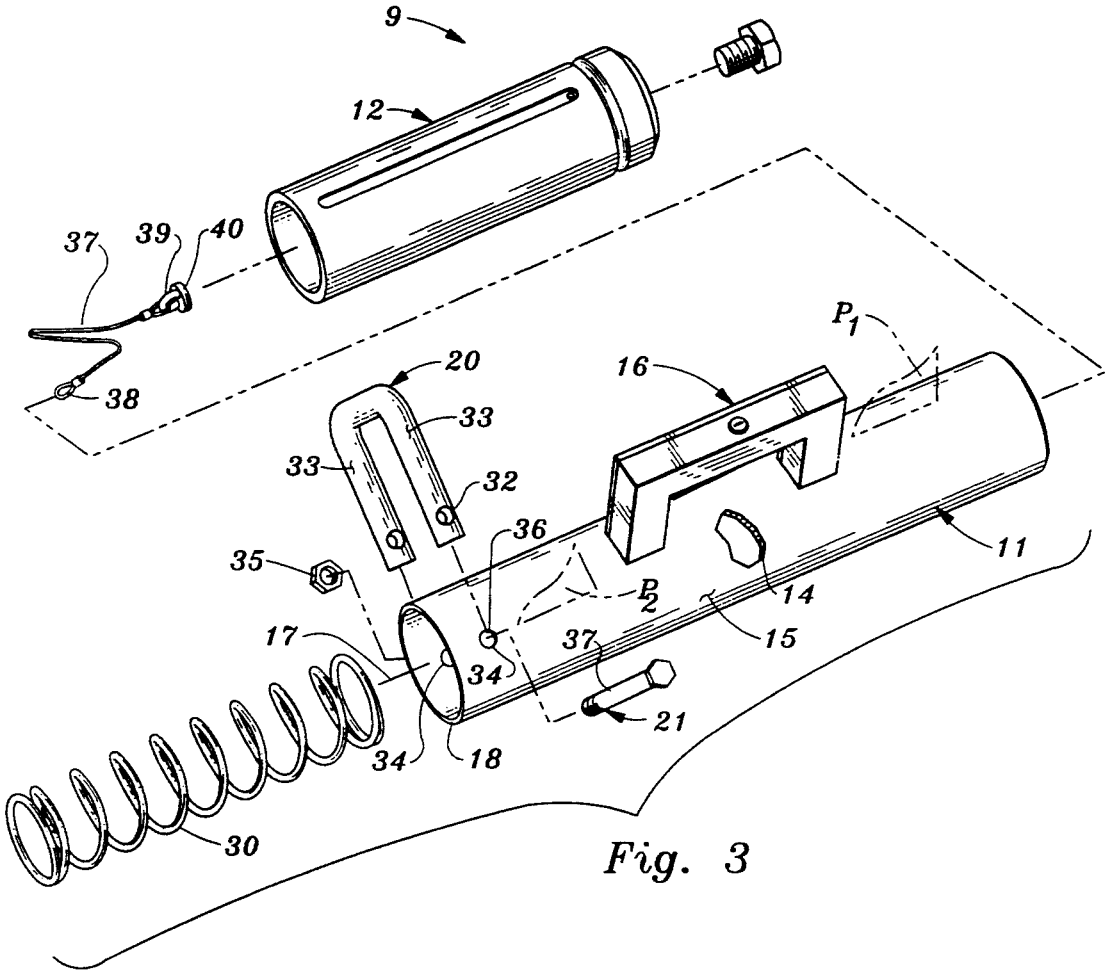
Fig. 3
Fig. 4
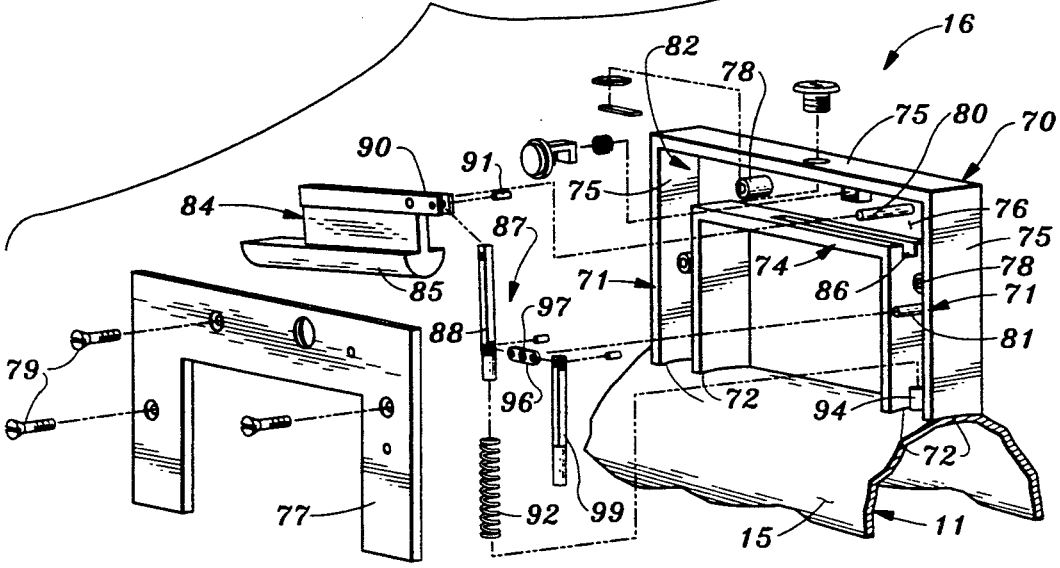

FORCING TOOL FOR LOCKED DOORS, GATES AND THE LIKE

SCOPE OF THE INVENTION

The present invention relates to tools for forcing the opening of lock, hinged doors, gates and the like and more specifically to a spring-activated portable toot for use by fire fighters, olicemen, rescue personnel and the like, for gaining forcible entry into a residence, business or the like by door knob from its support so that the associated hinged door, gate and the like can be swung to an open position.

BACKGROUND OF THE INVENTION

Forcible access tools for application in the law enforcement and rescue fields, have varied from a single man swinging a sledge hammer to a group effort using a battering ram having multiple tongs extending along the ram for hand manipulation. But where there is insufficient space at the door step for a group effort or insufficient swing space for the sledge hammer, there remains a need for an access tool that is singly manned and does not require annular swing space.

There are also a group of hydraulic operated access tools such as described in U.S. Pat. Nos. 5,048,795 and 4,443,001 that use a stationary jaw that is wedges into the door jam and a movable jaw that moves off the stationary jaw to wedge open the door. Various guide members have been proposed to keep the movable jaw on line during operations.

While considerable number of such tools have been devised, none had the combined features of easy portability, single-person ambidextrous usage, efficiency of usage without need for separate impact-type device for setting the tool, durability, low cost and effective in operation without need for hydraulic power to add power at the door site.

SUMMARY OF THE INVENTION

An access tool for smashing against a door knob of a door of describe and comprises a pair of telescoping cylinders. The outer guiding cylinder includes a side wall concentric of an axis of symmetry. A hoisting handle of U-shaped cross section is attached at one end of the outer cylinder (the hoisting handle including a pair of transverse legs having openings near the termini thereof) using a bolt-nut combination. The bolt includes a bolt shank extending through a pair of diametrically opposed openings in the side wall of the outer cylinder and thence through the openings in the transverse legs of the handle, whereby achieving pivotable attachment of the hoisting handle. The inner cylinder also includes a side wall that differs from that of the outer cylinder in that a stepped end wall is provided in the mid-region thereof. The stepped end wall includes a central opening for receiving an anvil bolt. A compression spring is positioned within the cylinders on a side opposite the anvil bolt in contact with the stepped end wall of the inner cylinder and the bolt shank of the hoisting handle wherein rectilinear movement of the inner cylinder in a direction toward the bolt shank, causes compression of the spring to provide a "cocked" action state for the cylinders. A unitary trigger mechanism and carrying handle is attached to the outer cylinder near a mid-region thereof for manipulation of the tool and for disconnectably connecting the outer and inner cylinders so as to provide both a locking state and to provide a release state.

The unitary trigger mechanism and carrying handle includes a hollow, U-shaped housing including a pair of transverse legs as well as a hollow longitudinal leg parallel with the inner and outer cylinders. The ends of the transverse legs attached to the outer cylinder via a series of welds. Within the cavity of the handle is a pivot bar. The pivot bar includes a semi-circular palm engagement section that extends out of that portion of the cavity defined by the longitudinal leg of the handle. After the tool has been place in a "cocked" condition, the trigger mechanism is activated by giving upward movement to the palm engagement section of the pivot by the palm of the user. Because of its assembly, the pivot bar pivots about an axis normal to the axis of symmetry of the cylinders. The pivot bar is pivotally attached to a horsehead segment that cantilevers from the pivot bar into one of the transverse legs of the U-shaped handle. Because of its construction the horsehead segment undergoes downward movement as a function of upward movement of the palm engagement section. Such movement drives a separate pump rod pivotally attached to the pivot bar against a spring positioned on the outer surface of the outer cylinder. At a mid-region of the pump rod there is pivotally attached a teeter bar having a central pin affixed across the transverse leg of the handle. Such downward movement of the pump rod is thus easily translated by the teeter bar into upward movement of a push-pull rod attached at the far end of the teeter bar so as to release the push-pull rod from an radial opening in the inner cylinder. Such release position assumes that the push-pull rod has been previously extended into such radial opening during the locking or cocked operating state of the tool. Result: when the push-pull rod is released, the inner cylinder is flung forward into contact with the door knob and decommissions the locking mechanism so that the door is free to be opened since a large amount of potential energy can be stored in the spring.

Efficiency of operations is somewhat dependent upon the diameter of the door knob and its associated knob plate. But irrespective of the size of the knob, the access tool of the present invention always contacts with the door knob and its environs and removes the knob and its attaching latch to permit easy entry through the door.

In operation, the user carries the tool to the site where the door opening operations may be required. Usually, the tool has been previously activated by the cocking of the inner cylinder using a battery activated hydraulic motor also carried to the use site.

In order that the tool not be activated by accident, the trigger mechanism also includes a keyed lock in combination with a user activated safety switch. Tandem operation of the lock and switch must occur before the palm-activated pivot bar can be operated. The safety switch ("dead man's) includes a button normally extending from the longitudinal leg of the handle in a transverse direction with respect of the longitudinal travel of the inner cylinder via spring loading. The button is attached to a rectangularly shaped, inverted U-shaped push member. The cavity formed between the pair of parallel legs of the push member is constructed to releasably receive a planar latch member attached to the keyed rotatable cylinder of the lock. In such position, the user cannot push the button and U-shaped push member against a spring within a keeper support attached to the longitudinal leg of the handle in axial alignment with the push member to release one of the parallel legs of the U-shaped member from the pivot bar. However, when the rotatable cylinder of the lock is properly rotated to release the planar latch member from the U-shaped push member, the user can push the U-shaped push member against the spring to allow the pivot bar to be released.

BRIEF DESCRIPTION OF THE DRAWINGS

FIG. 3 is an exploded view of the inner and outer cylinders of the FIGS. 1 and 2;

FIG. 4 is an exploded view of the trigger mechanism of FIGS. 1 and 2;

DETAILED DESCRIPTION OF AN EMBODIMENT OF THE INVENTION

Figure 1:
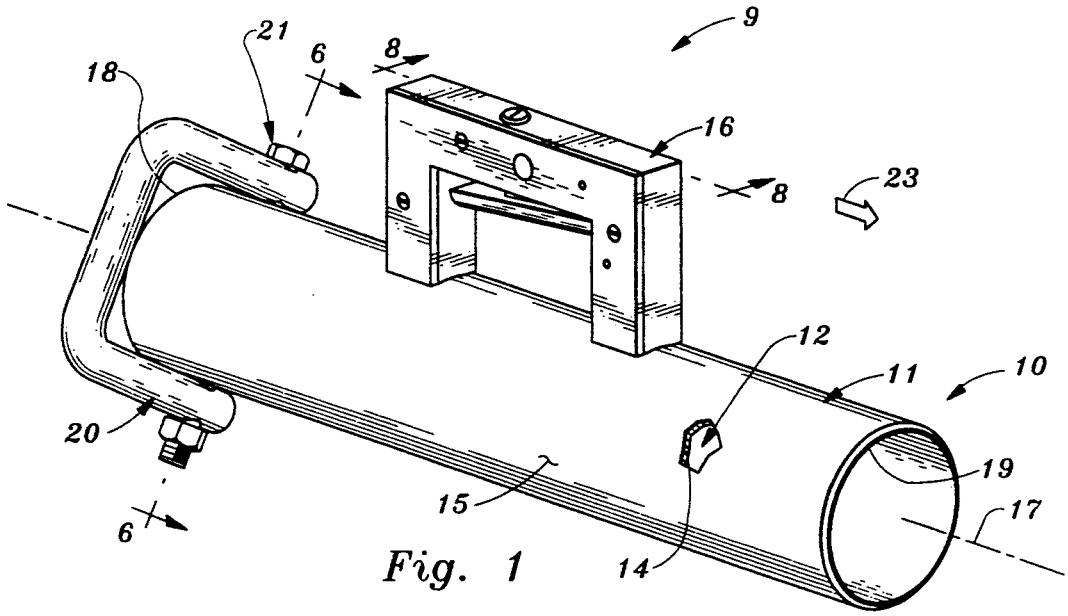
FIG. 1 is a perspective view of the access tool of the invention comprising telescoping inner and outer cylinders in which the inner cylinder has been "cocked" and held in such position by operation of a trigger mechanism.
Figure 2:
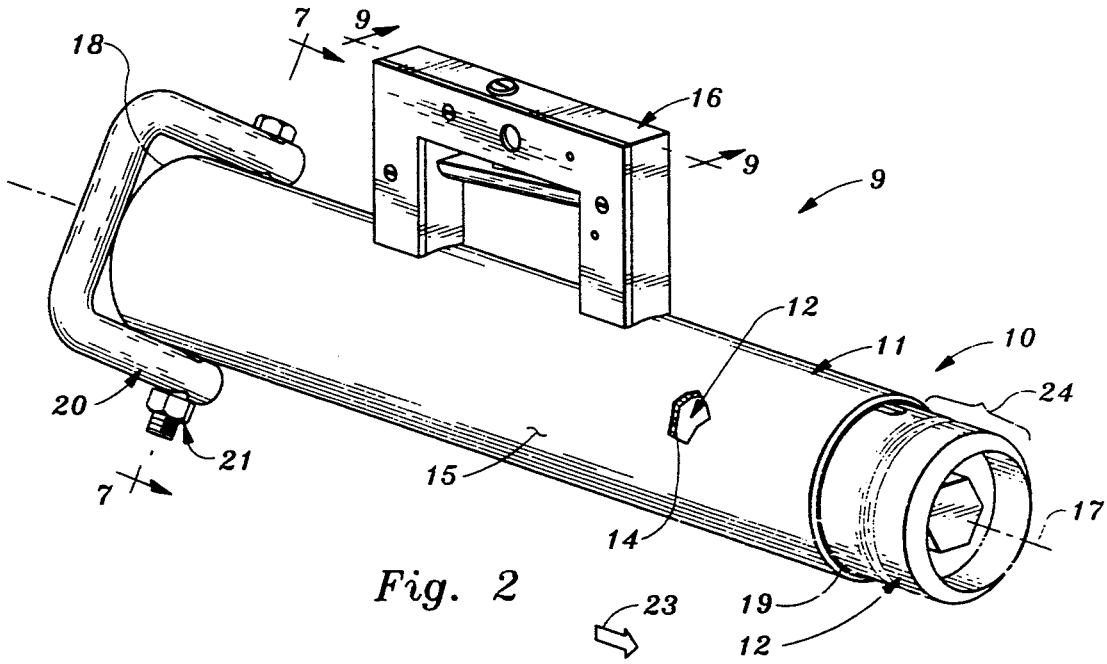
FIG. 2 is another perspective view of the access tool of the invention after the trigger mechanism has been activated and the inner cylinder caused to undergo travel relative to the outer cylinder.

Referring to FIGS. 1 and 2, the access tool 9 of the present invention relates to a pair of telescoping elongated elements enerally indicated at 10 comprising an outer guiding cylinder 11 concentric of a inner drive cylinder 12. The outer guiding cylinder 11 includes a side wall 14 those outer surface 15 supports an inverted U-shaped trigger mechanism 16. The side wall 14 is also concentric of a common axis of symmetry 17 and terminates in an open hoisting end 18 and an open activation end 19. Near the hoisting end 18, there is provided a hoisting handle 20 of U-shaped cross section attached to the outer surface 15 of the outer cylinder 11 by a bolt-not combination 21. In operation as explained below in detail, activation of the trigger mechanism 16 permits the inner cylinder 12 to undergo movement in the direction of arrow 23 so that a portion 24 of the cylinder 12 (see FIG. 2) protrudes beyond the activation end 19 of the outer cylinder 11.

FIG. 3 illustrates the access tool 9 of FIGS. 1 and 2 in more detail.

As shown, compression spring 30 is inserted through the hoist end 18 of the outer cylinder 11 to reside fully within the side wall 14 of the cylinder 11. Then inverted U-shaped hoisting handle 20 having aligned openings 32 in its pair of parallel legs 33 is positioned at the outer surface 15 of the outer cylinder 11.

The side wall 14 of the outer cylinder 11 is also provided with diametrically opposed openings 34 that (after alignment with openings 32 of the hoisting handle 20), can be used to received bolt shank 31 of the bolt-nut 21. Nut 35 is attached to the bolt shank 31 to complete attachment of the hoisting handle 20 to the outer cylinder 11.

Note that axis of symmetry 36 of the assembled bolt-not 21 is normal to and intersects the common axis of symmetry 17 of the cylinders 11, 12. Also the hoisting handle 20 is pivotable with respect to the outer cylinder 11 so as to provide different orientation for use by either a left- or right-handed person.

Orientation of the trigger mechanism 16 relative to openings 34 through the side wall 14 of the outer cylinder 11, may be of some importance. Note that a bisecting working plane P1 through the trigger mechanism 16 makes an angle less than 90 degrees relative to a bisecting working plane P2 of the openings 34 through the common axis of symmetry 17 of the cylinders 11, 12.

Bolt-not 21 not only attaches the hoisting handle 20 to the outer cylinder 11, but its bolt shank 31 is also of sufficient thickness at its intersection with the common axis of symmetry 17 of the cylinders 11, 12 to provide a solid, reaction brace for the spring 30. The spring 30 is disposed within the outer cylinder 11 before the handle 20 is attached. Note that the bolt shank 31 also serves as an anchor for safety cable 37 via eyelet 38 after the inner cylinder 12 is inserted through activation end 19 of the outer cylinder 11. The safety cable 37 has a second eyelet 39 remote from and opposite to the eyelet 38 having threads 40 for attachment to the inner cylinder 12 as explained in detail below.

Figure 6:
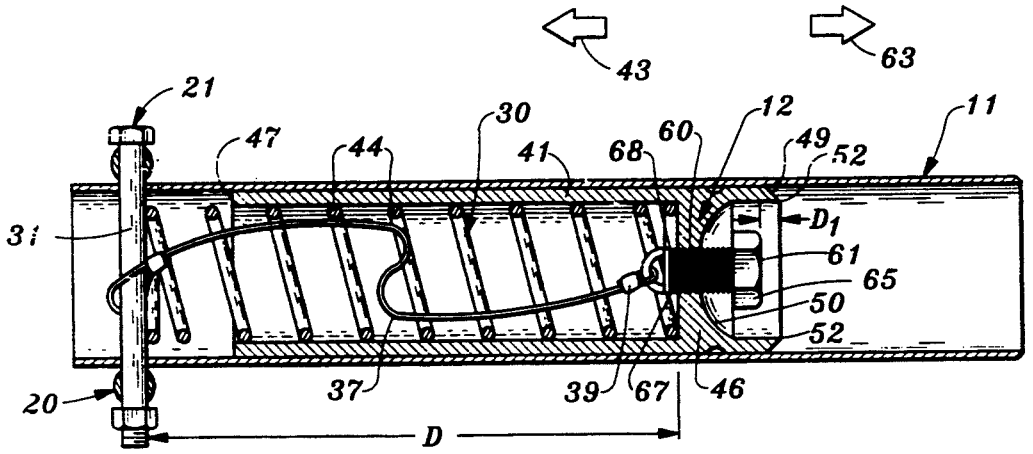
FIGS. 6 and 7 are sections along line 6—6 of FIG. 1 and line 7—7 of FIG. 2, respectively, illustrating the positions of the inner and outer cylinders and interconnected coiled spring, in locked ("cocked") and release states, respectively.
Figure 7:
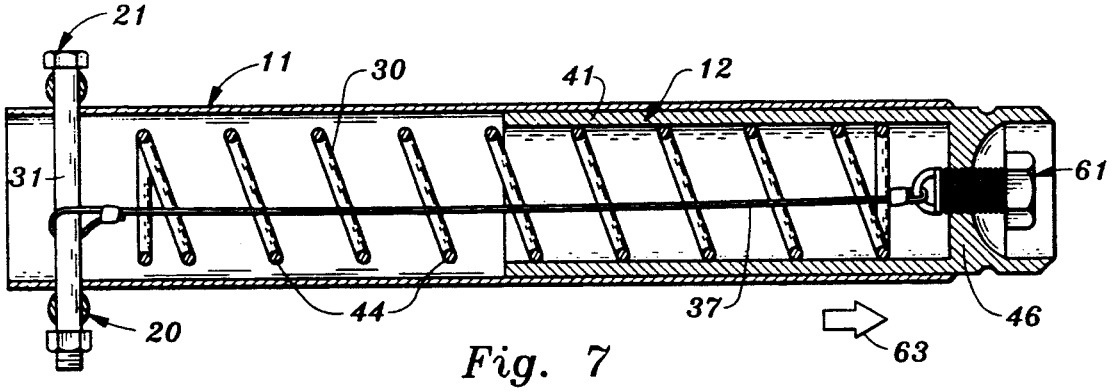

FIGS. 6 and 7 shows how operations affect the position of the safety cable 37 relative to the outer and inner cylinders 11, 12.

As shown in FIG. 6, after the inner cylinder 12 has been moved in the direction of arrow 43 relative to the outer cylinder 11 by compressing coils 44 of the spring 30 to reach a "cock" position, such inner cylinder 12 being held in such position by the action of trigger mechanism 16 of FIGS. 1 and 2, as explained below. Such movement is provided using a battery activated hydraulic motor (not shown) after the tool 9 is placed in a fixture (also not shown) carried in the vehicle used to tote the tool 9 to the use site.

In such position the length of the safety cable 37 between bolt shank 31 and stepped end wall 46 in the side wall 41 of the inner cylinder 12 is seen to be greater than the longitudinal distance D and lie loosely within the cylinders 11, 12. Note also that the side wall 41 of the inner drive cylinder 12 is of a constant thickness from open end 47 to the stepped end wall 46 and the balloons back to its original thickness at activation end 49. That is, from the stepped end wall 46, the side wall 41 of the inner cylinder 12 is swedged outwardly over curved surface 50 and terminates in the activation end 49. At such activation end 49, note that the side wall 41 of the inner cylinder 41 is chamfered to provide a sharpen edge 52 concentric of the common axis of symmetry 17 to facilitate penetration about door panel 55 of door 56 (see FIG. 5) in the region of knob 58, say exterior of knob plate 59.

Figure 5:
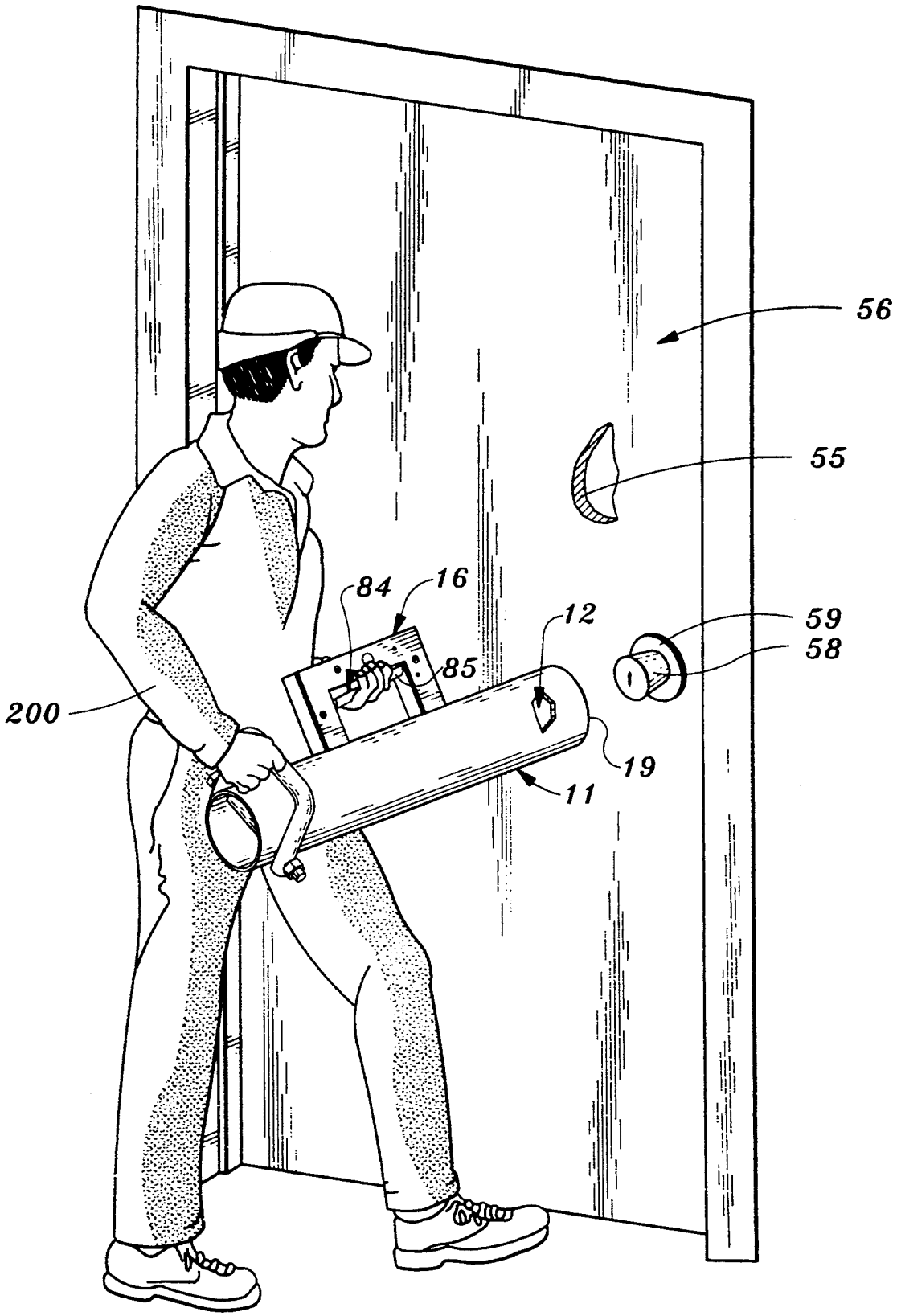
FIG. 5 is a perspective view of the access tool of FIGS. 1 and 2 about to used to smash the door knob and door plate of a hinged door.

Returning to FIG. 6, note that stepped end wall 46 is provided with a threaded central opening 60 concentric of the common axis of symmetry 17 of the cylinders 11, 12. Such threaded opening 60 receives both the eyelet 39 attached to the safety cable 37 and an anvil bolt 61 but in opposite longitudinal directions. That is, the anvil bolt 61 extends from the opening 60 in the direction of arrow 63 while eyelet 39 extends from the opening 60 in the direction of arrow 43. Note the anvil bolt 61 includes an enlarged bolt head 65 which acts as the ramming anvil against the door knob 58 of the door 56 (FIG. 5). Note that the longitudinal distance D1 from the bolt head 65 to the chamfered edge 52 is variable to assure that the ramming anvil bolt head 65 makes first contact with the knob 58 (FIG. 5). Note also that the anvil bolt 61 is easily replaceable when damaged. The eyelet 39 attached to the cable 37, has a base in contact with end 67 of bolt shank 68 of the anvil bolt 61 thereby preventing rotation of either the eyelet 39 or the anvil bolt 61 during operations.

As shown in FIG. 7, the inner cylinder 12 has moved in the direction of arrow 63 relative to the outer cylinder 11 by release of potential energy previously stored in the coils 44 of the spring 30 via operation of the trigger mechanism 16 of FIGS. 1 and 2. As a result, the inner cylinder 12 reaches a "full release" position as shown. In such position, it is assume that such release was not interrupted by the anvil bolt 61 contacting a target such as knob 58 (FIG. 5). Hence, in FIG. 7, the full shock of the release of the inner cylinder 12 has been accepted by the safety cable 37. Hence the cable 37 is closely aligned with the common axis of symmetry 17 of the cylinders 11, 12, fully extended as shown.

TRIGGER MECHANISM 16

FIGS. 4, 8, 9, 10 and 11 show the trigger mechanism 16 in more detail, wherein FIG. 4 is an exploded view thereof.

As shown in FIG. 4, the trigger mechanism 16 includes an inverted U-shaped housing 70. The housing 70 includes a pair of hollow transverse legs 71 having ends 72 welded to exterior surface 15 of the outer cylinder 11, and a hollow longitudinal leg 74. The transverse legs 71 and the longitudinal leg 74 are each of rectangular cross section and are constructed of a series of side walls 75, a rear wall 76 and a front wall 77. The front wall 77 is attached to threaded bosses 78 depending from the rear wall 76 by a series of screws 79. Also cantilevered from the rear wall 76 are fixed pins 80, 81 which attach to varies elements of the trigger mechanism 16 as explained below. Located within the hot low cavity 82 of the transverse and longitudinal legs 71, 74 is a pivot bar 84 having a semi-circular palm engagement section 85 that extends out of that portion of the cavity 82 defined by the longitudinal leg 74, via a slot 86. The pivot bar 84 is pivotally attached to a horsehead segment generally indicated at 87 that cantilevers from the pivot bar 84 and is positioned within one of the transverse legs 71. The horsehead segment 87 includes a pump rod 88 (pivotally attached between support bars 90 of the pivot bar 84 via peg 91) and a return spring 92. The spring 92 is attached between 1the pump rod 88 and keeper 94 attached to the outer cylinder 11, such spring 92 normally biasing the horsehead segment 87 in an upward direction. Because the fixed pin 80 is attached to the pivot bar 84, when the palm engagement section 85 undergoes upward movement, the horsehead segment 87 undergoes downward movement. Such movement drives the separate pump rod 88 against the spring 92. Along a mid-region of the pump rod 88 note the attachment of a teeter bar 96 having a central opening 97 through which the fix pin 81 extends. As a result, the downward movement of the pump rod 88 is thus easily translated by the teeter bar 96 into upward movement of a push-pull rod 98 attached at end 99 of the teeter bar 96 opposite to the pump rod 88.

Figure 8:
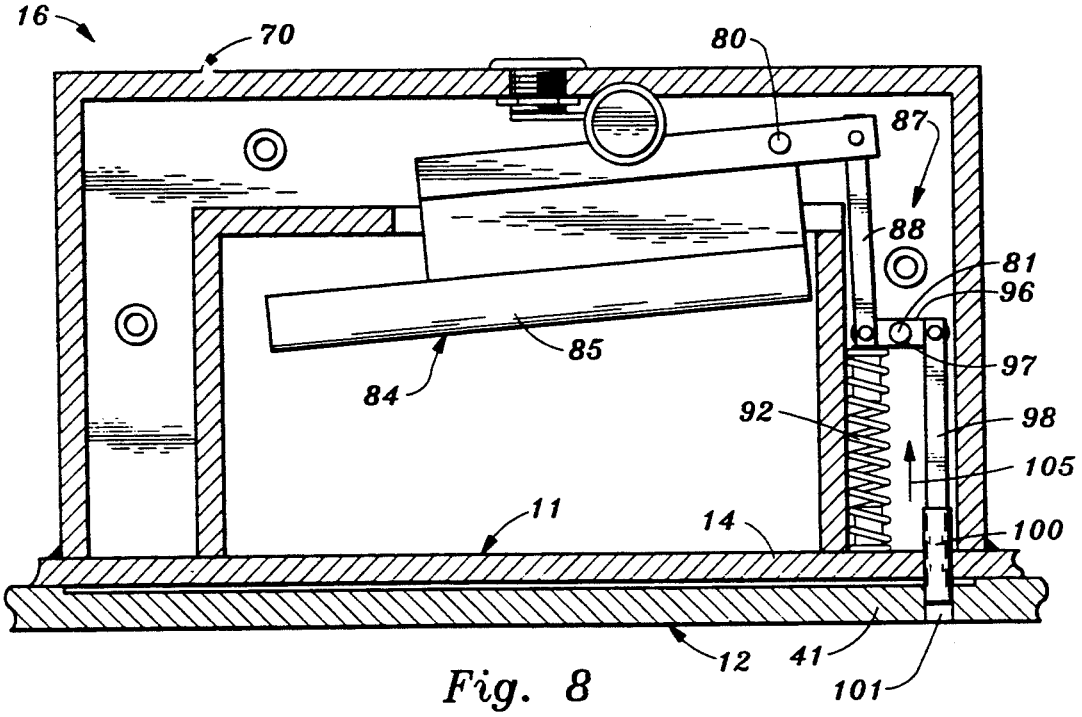
FIG. 8 is a section along line 8—8 of FIG. 1 showing the trigger mechanism in a "cocked" state for holding the inner and outer cylinders relative to the coiled spring.
Figure 9:
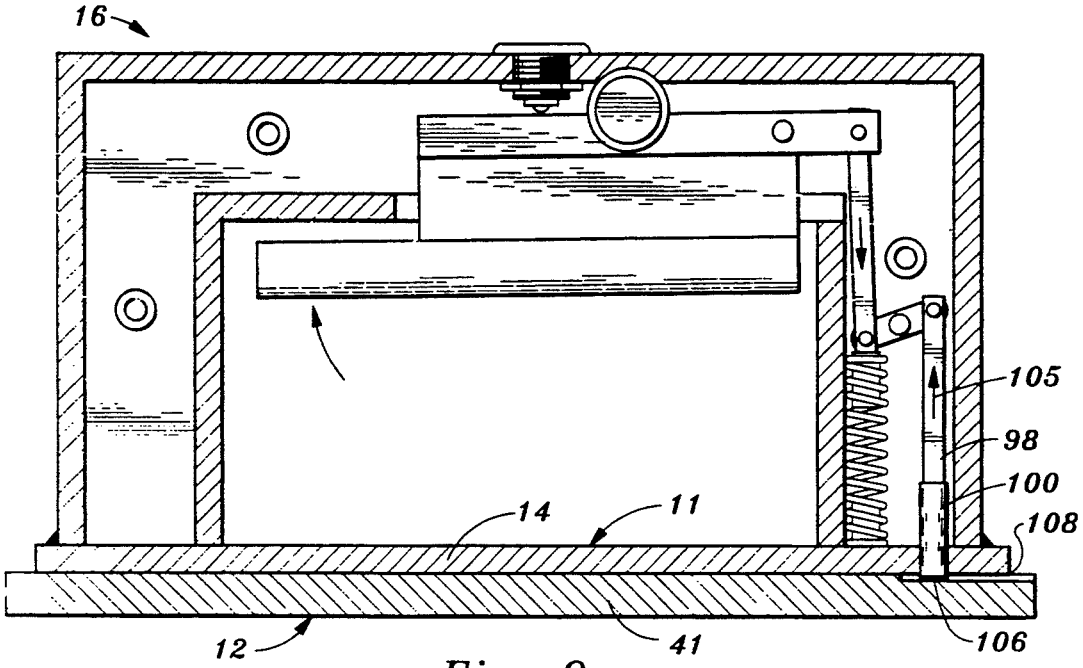
FIG. 9 is a section along line 9—9 of FIG. 2 showing the trigger mechanism in a released state.

FIGS. 8 and 9 illustrate these operations in more detail.

As shown in FIG. 8, the push-pull rod 98 is positioned within a pair of radially aligned openings 100 and 101, the opening 100 being formed in the side wall 14 of the outer cylinder 11 and in the side wall 41 of the inner cylinder 12, respectively. As a result, the inner cylinder 12 is in a "cocked" position relative to the outer cylinder 11, see FIG. 1. Because the pivot bar 84 is pivotally attached relative to the housing 70 via fixed pin 80, when the palm engagement section 85 undergoes upward movement, the horsehead segment 87 undergoes downward movement. Such movement drives the separate pump rod 88 against the spring 92. But teeter bar 96 has been pivotally attached to the housing 70 via fixed pin 81 penetrating through central opening 97. As a result, the downward movement of the pump rod 88 is thus easily translated by the teeter bar 96 into upward movement of a push-pull rod 98 attached at the teeter bar 96 opposite to the pump rod 88. Result: The push-pull rod 98 can be easily released from the radial opening 101 in the side wall 41 of the inner cylinder 12 by undergoing upward movement.

FIG. 9 depicts the position of the inner cylinder 12 after such rectilinear travel has been completed. Note that end 106 of the push-pull rod 98 resides within the radial opening 100 in the side wall 14 of the outer cylinder 11 as well as within the slit 108 which has a depth less than the thickness of the side wall 41 of the inner cylinder 12. As a result, rotation of the inner cylinder 12 is prevented by the fact that the end 106 of the push-pull rod 98 remains within the longitudinal slit 108 in the inner cylinder 12.

Figure 10:
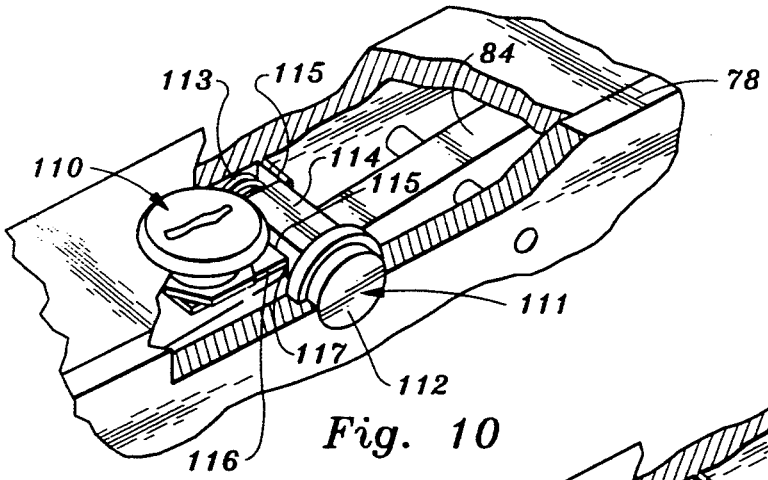
FIG. 10 is a detailed perspective view of keyed lock in combination with a user-activated safety switch for use in preventing accidental activation of the trigger mechanism of FIGS. 8 and 9, such keyed lock being rotated to a position that prevents operation of the safety switch.
Figure 11:
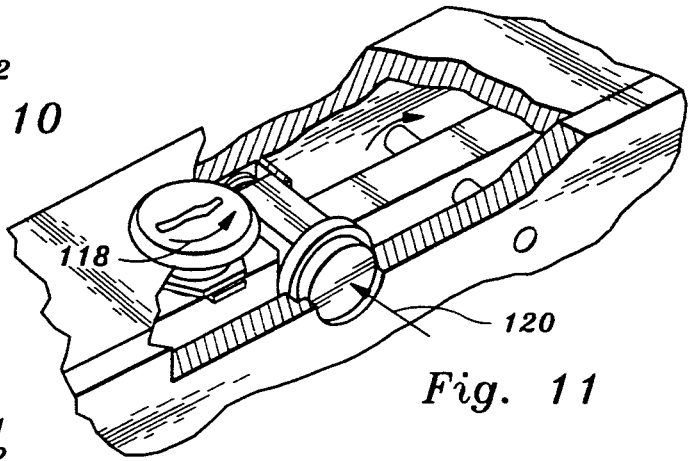
FIG. 11 is another detailed perspective view of keyed lock of FIG. 10 in combination with a user-activated safety switch for use in preventing accidental activation of the trigger mechanism of FIGS. 8 and 9, such keyed lock being rotated to a position that allows operation of the safety switch.

FIGS. 10 and 11 depicts a safety feature of the trigger mechanism 16. Such safety feature is provided in order that the tool 9 not be activated by accident. As shown, the trigger mechanism 16 also includes a keyed lock 110 in combination with a user activated safety switch 111. Tandem operation of the lock 110 and switch 111 must occur before the palm-activated pivot bar 84 can be operated. The safety switch 111 ("dead man's) includes a button 112 normally extending from the housing 70 in a transverse direction under the spring force provided by spring 113. The button 112 is attached to a rectangularly shaped, inverted U-shaped push member 114 that resides with a keeper housing 115 bearing against the spring 113, The lock 110 includes a rotatable tumbler (not shown) attached to a planar latching member 116 that extends into cavity 115 of the push member 114.

That is, the cavity 115 formed between a pair of parallel legs 117 of the push member 114 is constructed to releasably receive the latching member 116 attached to the keyed rotatable tumbler of the lock 110. In such position, the user cannot push the button 112 and cause rectilinear movement of the push member 114 against the spring 113 within the keeper housing 115 attached to rear wall of the longitudinal leg 74. However, when the rotatable tumbler of the lock 110 is rotated in the direction of arrow 118, the planar latching member 116 is released from the cavity 115 of the push member 114 so that the user can push the U-shaped push member 114 in the direction of arrow 120 to allow the pivot bar 84 to undergo pivoting operations as previously described.

OPERATIONS

In operation, the user carries the tool 9 to the site where the door opening operations may be required. Usually, the tool 9 has been previously activated so that the inner and outer cylinders 11, 12 are positioned as shown in FIG. 1. Such positioning is established by the cocking of the inner cylinder 12 by forced movement against the normal biasing pressure of the spring 30. Establishing such forced movement is via a battery activated hydraulic motor (not shown) also carried to the use site in the vehicle used in the transportation of the tool 9.

The user 200 of FIG. 5 then totes the tool 9 to the door site as shown in FIG. 5. The user 200 places the open activation end 19 of outer cylinder 11 over the knob 58 of the door 56 and activates the trigger mechanism 16. The user 200 provides upward movement to the palm engagement section 85 of the pivot bar 84 of the trigger mechanism 16. Because of its assembly, the pivot bar 84 pivots about an axis normal to the common axis of symmetry of the cylinders to permit release of the inner cylinder 11 from the outer cylinder 12 as previously explained. Result: the inner cylinder 12 is flung forward in the direction of and into contact with the knob 58. As a result, the knob 58 is decommissioned since a large amount of potential energy can be stored in placing the inner cylinder 12 in a "cocked" position. The door 56 swings open for easy entry.

Efficiency of operations is somewhat dependent upon the diameter of the knob 58 and the knob plate 59. But irrespective of the size of the knob 58, the tool 9 of the present invention always initially contacts the door knob 58 and decommissions its attaching latch (not shown) to permit easy entry.

Figure 12:
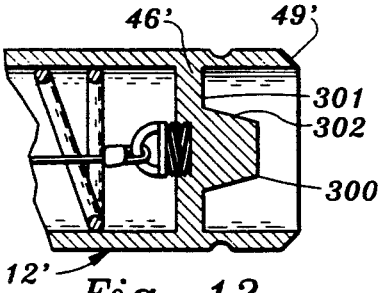
FIG. 12 is detail sectional view of the stepped end wall of the inner cylinder of FIG. 6 modified to provide a bulbous member.

Although the preferred embodiment of the invention has been described, it is understood that the principles of the invention are applicable to other forms as readily apparent to those skilled in the art. For example, as shown in FIG. 12, the end wall 46' of the inner cylinder 12' can be formed with a bulbous member 300 xtending from broad surface 301 of the end wall 46' facing toward he open end 49' of the inner cylinder 12'. The bublous member 300 has an apex 302 that is positioned slightly behind open end 49' of the inner cylinder 12' for contacting the door knob 58 of FIG. 5 during operations as previously described. Hence the invention should only be limited by the spirit of the appended claims.

I claim:

1. An access tool for smashing against a door knob of a door comprising a pair of telescoping cylinders having a common axis of symmetry and including an outer guiding cylinder concentric of an inner drive cylinder, said outer guiding cylinder including a side wall defining an open activation end and an open hoisting end, a hoisting handle of U-shaped cross section attached to said outer surface of the outer cylinder adjacent to said hoisting end of said outer cylinder, said hoisting handle including a pair of transverse legs having openings near the termini thereof, a bolt means including a bolt shank extending through said said side wall of said outer guiding cylinder and through said openings in said transverse legs of said handle, whereby said hoisting handle is pivotable attached with respect to said outer cylinder so as to provide different orientation for use by either a left- or right-handed person, a compression spring positioned within said outer cylinder having a first end coil in contact with said bolt shank and a second end coil opposite to said first end coil, said inner drive cylinder including a side wall having a transverse end wall formed near a mid-region thereof, and being open at both ends remote from said transverse end wall, said transverse end wall having a first broad surface facing said compression spring in bearing contact with said second end coil and a second broad surface facing in an opposite direction to said compression spring, an anvil bolt attached to said central opening of said transverse end wall, said anvil bolt cantilevering from said second broad surface of said transverse end wall and terminating in an enlarged bolt head, a unitary trigger mechanism and carrying handle attached to said outer cylinder near a mid-region thereof for aiding in single user manipulation of said tool as well as for disconnectably connecting said outer and inner cylinders to provide a locked state for said cylinders and to provide a release state whereby in said release state, said inner cylinder undergoes rectilinear travel relative to said outer cylinder wherein at least said anvil bolt attached to said transverse end wall of said inner cylinder is caused to contact a door knob of a closed door with surprising force.

2. The access tool of claim 1 in which said side wall of said inner cylinder is swedged outward from said transverse end wall to form an activation end having a chamfered edge honed to a sharpness and defining a terminal plane.

3. The access tool of claim 2 in which said central opening in said transverse end wall is threaded to receive said anvil bolt whereby wherein the longitudinal distance from said anvil bolt head to said terminal plane of said chamfered edge of said side wall of inner cylinder is variable whereby during said release state when said inner cylinder undergoes rectilinear travel relative to said door knob, initial contact therebetween occurs at said anvil bolt.

4. The access tool of claim 1 with the addition of a safety cable positioned within said inner and outer cylinders, said safety cable having a first end attached to said bolt shank of said bolt means, and a second end opposite to said first end, said cable including an eyelet at said second end connected to said threaded central opening and cantilevering from said first broad surface of said transvese end wall of said inner cylinder.

5. The access tool of claim 1 in which said unitary trigger mechanism and carry handle includes an inverted U-shaped, hollow housing having a pair of transverse legs in end contact with said outer cylinder and a longitudinal leg attached between said transverse legs having an axis of symmetry parallel to said common axis of symmetry of said cylinders but offset therefrom, an interior cavity and a slot in communication with said cavity, a pivot bar pivotally attached to said longitudinal leg and including a semi-circular palm engagement section defining a portion that extends out of said cavity through said slot grippable by a hand of a user and a horsehead segment pivotally attached to said pivot bar and including means pivotally attached within one of the transverse legs and movable in association with movement of said pivot bar to disconnectable connect said inner cylinder relative to said outer cylinder.

6. The access tool of claim 5 in which said horsehead segment includes a separate spring loaded pump rod having one end pivotally attached to said pivot bar and a second end attached to outer cylinder, and in which said means of said horsehead segment includes a teeter bar having a first end pivotally attached to a mid-region of said pump rod and a second end, and a push-pull rod pivotally attached to said second end of said teeter bar is normally spring biased in a direction toward to said common axis of symmetry of said cylinders but whereby movement of said pivot bar is translated to movement of said push-pull rod in a direction away from said common axis of symmetry of said cylinders to release said inner cylinder relative to said outer cylinder.

7. The access tool of claim 6 in which said side walls of said inner and outer cylinders each include a radial opening having an axis of symmetry normal to said common axis of symmetry of said cylinders, wherein in said locked ("cocked") state, said radial openings are radially aligned with said push-pull rod residing therein and wherein in said released state, said push-pull rod is removed from said radial opening in said inner cylinder but remains within said radial opening in said outer cylinder.

8. The access tool of claim 7 with the addition of a longitudinal slit in said outer cylinder having an end in communication with said radial opening in said outer cylinder, said slit having a depth less than the thickness of said side wall, said push-pull rod remaining in said slit during said release state to prevent rotation of said inner cylinder during rectilinear movement thereof relative to said outer cylinder.

9. The access tool of claim 5 with the addition of a keyed lock and a manually operated safety switch attached to said longitudinal leg of said housing in disconnectable connection with said pivot bar to prevent accidental operation of said pivot bar.

10. The access tool of claim 9 in which said safety switch includes spring loaded a rectangularly shaped, inverted U-shaped push member extending transverse to and above said pivot bar, said member including a pair of transverse legs, and a spring in loading contact with one of said transverse legs to urge another of said transverse legs in contact said pivot bar and prevents rotation thereof in a normal state of operation, but is manually movable along a travel path above said pivot bar against said spring to permit rotation of said pivot bar.

11. The access tool of claim 10 in which said keyed lock includes a rotatable, key driven planar latch rotatable within said travel path of said U-shaped push member to prevent manual movement thereof.

12. The access tool of claim 1 in which said movement of said inner cylinder relative to said outer cylinder in a direction toward said hoisting end of said outer cylinder creates a surprising large amount of potential energy stored said spring whereby sufficient force is available when said release state occurs that said door knob is easily decommissioned.

13. In gaining forced entry to a residence, business and the like, the combination of a door having a door knob preventing entry into a residence, business and the like, an access tool for smashing against said door knob including a pair of telescoping cylinders having a common axis of symmetry and including an outer guiding cylinder concentric of an inner drive cylinder, said outer guiding cylinder including a side wall defining an open activation end and an open hoisting end, a hoisting handle of U-shaped cross section attached to said outer cylinder adjacent to said hoisting end of said outer cylinder, said hoisting handle including a pair of transverse legs having openings near the termini thereof, a bolt means including a bolt shank extending through said diametrically opposed openings in said side wall of said outer guiding cylinder and through said openings in said transverse legs of said handle, whereby said hoisting handle is pivotable attached with respect to said outer cylinder so as to provide different orientation for use by either a left- or right-handed person, a compression spring positioned within said outer cylinder having a first end coil in contact with said bolt shank and a second end coil opposite to said first end coil, said inner drive cylinder including a side wall having a stepped end wall formed near a mid-region thereof, and being open at both ends remote from said stepped end wall, said end wall having a first broad surface facing said compression spring in bearing contact with said second end coil and a second broad surface facing in an opposite direction to said compression spring, an anvil bolt attached to said central opening of said end wall, said anvil bolt cantilevering from said second broad surface of said end wall and terminating in an enlarged bolt head, a unitary trigger mechanism and carrying handle attached to said outer cylinder near a mid-region thereof for aiding in single user manipulation of said tool as well as for disconnectably connecting said outer and inner cylinders to provide a locked ("cocked") state between said cylinders and to provide a release state whereby in said release state, said inner cylinder undergoes rectilinear travel relative to said outer cylinder wherein at least said anvil bolt attached to said stepped end wall is caused to contact said door knob of said door with surprising force to gain forced entry therethrough.

14. The combination of claim 13 in which said side wall of said inner cylinder of said access tool is swedged outward from said stepped end wall to form an activation end having a chamfered edge honed to a sharpness and defining a terminal plane.

15. The combination of claim 14 in which said central opening in said stepped end wall of said access tool is threaded to receive said anvil bolt whereby wherein the longitudinal distance from said anvil bolt head to said terminal plane of said chamfered edge of said side wall of inner cylinder is variable whereby during said release state when said inner cylinder undergoes rectilinear travel relative to said door knob, contact initially occurs at said anvil bolt with respect to said door knob.

16. The combination of claim 13 with the addition of a safety cable positioned within said inner and outer cylinders of said access tool, said safety cable having a first end attached to said bolt shank of said bolt means for attaching said hoisting handle relative to said outer cylinder, and a second end opposite to said first end including an eyelet attached to said threaded central opening in said stepped end wall of said inner cylinder from a direction opposite to said anvil bolt.

17. The combination of claim 13 in which said unitary trigger mechanism and carry handle of said access toot includes an inverted U-shaped, hollow housing having a pair of transverse legs in end contact with said outer cylinder and a longitudinal leg attached between said transverse legs having an axis of symmetry parallel to said common axis of symmetry of said cylinders but offset therefrom, an interior cavity and a slot in communication with said cavity, a pivot bar pivotally attached to said longitudinal leg and including a semi-circular palm engagement section defining a portion that extends out of said cavity through said slot grippable by a hand of a user and a horsehead segment pivotally attached to said pivot bar and including means pivotally attached within one of the transverse legs and movable in association with movement of said pivot bar to disconnectable connect said inner cylinder relative to said outer cylinder.

18. The combination of claim 17 in which said horsehead segment of said access tool includes a separate spring loaded pump rod having one end pivotally attached to said pivot bar and a second end attached to outer cylinder, and in which said means of said horsehead segment includes a teeter bar having a first end pivotally attached to a mid-region of said pump rod and a second end, and a push-pull rod pivotally attached to said second end of said teeter bar is normally spring biased in a direction toward to said common axis of symmetry of said cylinders but whereby movement of said pivot bar is translated to movement of said push-pull rod in a direction away from said common axis of symmetry of said cylinders to release said inner cylinder relative to said outer cylinder.

19. The combination of claim 18 in which said side walls of said inner and outer cylinders of said access tool each include a radial opening having an axis of symmetry normal to said common axis of symmetry of said cylinders, wherein in said locked ("cocked") state, said radial openings are radially aligned with said push-pull rod residing therein and wherein in said released state, said push-pull rod is removed from said radial opening in said inner cylinder but remains within said radial opening in said outer cylinder.

20. The combination of claim 18 with the addition of a keyed lock and a manually operated safety switch attached to said longitudinal leg of said housing of said access tool in disconnectable connection with said pivot bar to prevent accidental operation of said pivot bar.

21. The combination of claim 20 in which said safety switch of said access tool includes spring loaded a rectangularly shaped, inverted U-shaped push member extending transverse to and above said pivot bar, said member including a pair of transverse legs, and a spring in loading contact with one of said transverse legs to urge another of said transverse legs in contact said pivot bar and prevents rotation thereof in a normal state of operation, but is manually movable along a travel path above said pivot bar against said spring to permit rotation said of pivot bar.

22. The combination of claim 21 in which said keyed lock of said access tool includes a rotatable, key driven planar latch rotatable within said travel path of said U-shaped push member to prevent manual movement thereof.

23. In gaining forced entry to a residence, business and the like, the combination of a door having a door knob preventing entry into a residence, business and the like, an access tool for smashing against said door knob including a pair of telescoping cylinders having a common axis of symmetry and including an outer guiding cylinder concentric of an inner drive cylinder, said outer guiding cylinder including a side wall defining an open activation end and an open hoisting end, a hoisting handle of U-shaped cross section attached to said outer cylinder adjacent to said hoisting end, said hoisting handle including a pair of transverse legs having openings near the termini thereof, a bolt means including a bolt shank extending through said side wall of said outer cylinder and through said openings in said transverse legs of said hoisting handle, whereby said hoisting handle is pivotable attached with respect to said outer cylinder so as to provide different orientation for use by either a left- or right-handed person, a compression spring positioned within said outer cylinder having a first end coil in contact with said bolt shank and a second end coil opposite to said first end coil, said inner drive cylinder including a side wall having a transverse end wall formed near a mid-region thereof, and being open at both ends remote from said transverse end wall, said transverse end wall having a first broad surface facing said compression spring in bearing contact with said second end coil and a second broad surface facing in an opposite direction to said compression spring, said second broad surface including a bulbous means formed along said common axis of symmetry of said cylinders extending toward one of said open ends of said inner cylinder but being coextensive of said side wall thereof, a unitary trigger mechanism and to carrying handle attached to said outer cylinder near a mid-region thereof for aiding in single user manipulation of said tool as well as for disconnectably onnecting said outer and inner cylinders to provide locking between said cylinders to provide a locked state and to provide a release state whereby said release state, said inner cylinder undergoes rectilinear travel relative to said outer cylinder wherein at least said bulbous means is caused to contact said door knob of said door with surprising force.

* * * * *